US007534114B2

(12) United States Patent
Liao

(10) Patent No.: US 7,534,114 B2
(45) Date of Patent: May 19, 2009

(54) LAND GRID ARRAY CONNECTOR ASSEMBLY WITH PICK UP CAP

(75) Inventor: Fang-Jun Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,112

(22) Filed: Aug. 20, 2007

(65) Prior Publication Data

US 2008/0038938 A1 Feb. 14, 2008

(51) Int. Cl.
*H01R 13/44* (2006.01)

(52) U.S. Cl. ..... 439/135; 439/940

(58) Field of Classification Search ..... 439/41, 439/135, 149, 940

See application file for complete search history.

(56) References Cited

U.S. PATENT DOCUMENTS 6,561,825 B1 * 5/2003 McHugh et al. ..... 439/135
6,655,970 B2 * 12/2003 Tsai ..... 439/135
6,877,990 B2 * 4/2005 Liao et al. ..... 439/41
7,195,493 B1 * 3/2007 Polnyi ..... 439/70

* cited by examiner

*Primary Examiner*—Khiem Nguyen
(74) *Attorney, Agent, or Firm*—Wei Te Chung

(57) ABSTRACT

A land grid array (LGA) connector assembly (1), comprising: a stiffener (2) defining locating members (4) around the respective corners for receiving and holding the electronics package in position; an insulative housing (3), the housing defining a plurality of contact segments (31, 32, 33, 34) for engaging respective connection sections of an electronics package; a plurality of electrical contacts received in the contact segments (31, 32, 33, 34) of the housing (3); a pick up cap (5) removeably attached to the stiffener (2), providing a smooth flat top surface (501) facilitating to be capable of being handled by a device, thereby manipulating the LGA connector assembly (1) to a desired location on a substrate circuit.

14 Claims, 3 Drawing Sheets

LAND GRID ARRAY CONNECTOR ASSEMBLY WITH PICK UP CAP

BACKGROUND OF THE INVENTION

1. Field of the Invention

The present invention relates to a land grid array (LGA) connector assembly, and more particularly to a connector assembly with a pick up cap directly and removably attached to a stiffener surrounding the socket for facilitating easily and readily placement of the socket onto a substrate.

2. Description of the Prior Art

A conventional land grid array (LGA) connector may be referred to U.S. Pat. No. 7,195,493 is widely used on electronics device and used for connecting an electronics package with a circuit board. Such an LGA connector typically comprises an insulative housing, a plurality of electrical contacts received in the housing, and a stiffener seated around the housing and defining locating members around the respective corners for receiving and holding the electronics package in position. The stiffener is mounted on the circuit board with the insulative housing and the electrical contacts are connected with the circuit board, and then assembling the electronics package on the housing for achieving the connection between the electronics package and the circuit board.

However, a problem exerts with this kind of the LGA connector: the connector is usually mount onto the circuit board by manual operation, this moving way is inefficient and easy to damage the electrical contacts in moving process.

U.S. Pat. No. 6,877,990 issued to Fang-Jun Liao on Apr. 12, 2005 disclosed a typical example for an LGA connector assembly, as it can be best illustrated by FIG. 1. The pick up cap is attached to the clip for reliably move and accurately position the LGA connector onto the circuit board. Another typical example is the connector assembly such as U.S. Pat. No. 6,905,353 issued to Hao-Yun, Ma on Jun. 14, 2005, as best illustrated by FIG. 1. The pick up cap is attached to the housing for reliably move and accurately position the LGA connector onto the circuit board. Above patents disclose the pick up cap clasps the housing or the clip surrounding the stiffener, it seems those ways can resolve the movement problem of the connector assembly, but there are still some problems in above connector assemblies, such as the pick up cap is easy to damage by the clip or lever and we need a new movement way because the clip or the lever may be removed for the demand for ever smaller electronics devices.

Therefore, a new electrical connector assembly that overcomes above-mentioned disadvantages is desired.

SUMMARY OF THE INVENTION

Accordingly, an object of the present invention is provision of a land grid array (LGA) connector assembly easy to move and can prevent damaging the electrical contacts in moving process.

To achieve the above-mentioned object, an LGA connector assembly in accordance with a preferred embodiment comprises an LGA connector and a pick up cap. The connector comprises an insulative housing, a plurality of electrical contacts received in the housing, and a stiffener seated around the housing and defining locating members around the respective corners for receiving and holding the electronics package in position. A pick up cap removably attaches to the stiffener and facilitates to be capable of being handled by a device, thereby manipulating the LGA connector assembly to a desired location on a circuit board accurately.

Compared with the conventional LGA connector, the present invention has following advantages: the LGA connector assembly comprises a pick up cap which can be handled by a device, and the connector assembly can be mounted on the circuit board accurately by the pick up cap, and moreover, the contacts received in the housing can avoid damaging because the pick up cap covers the top surface of the housing.

DETAILED DESCRIPTION OF THE PREFERRED EMBODIMENT OF THE INVENTION

Reference will now be made to the drawings to describe the present invention in detail.

Figure 1:
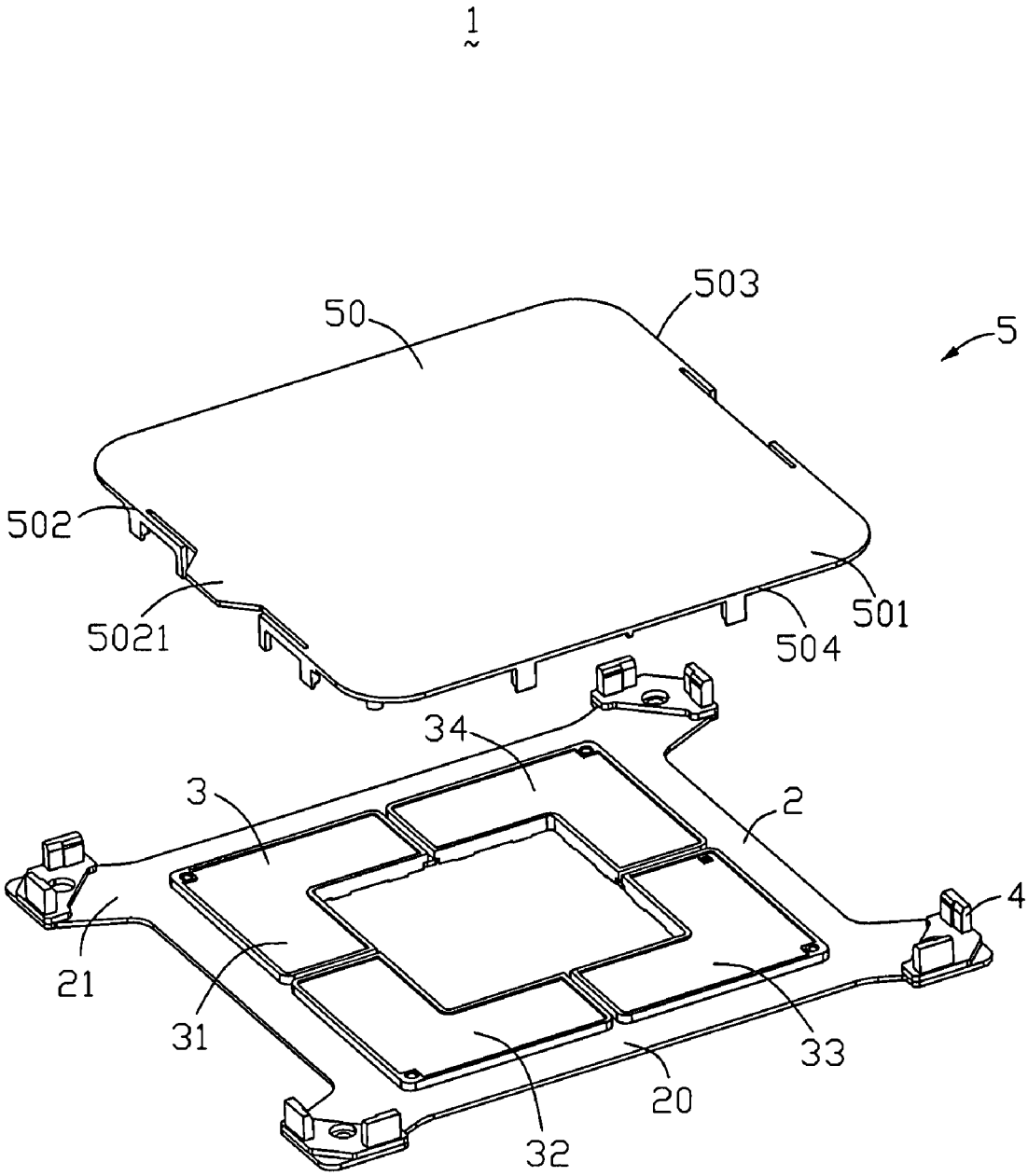
FIG. 1 is an exploded, isometric view of an LGA connector assembly of the present invention.

FIG. 1 shows an exploded, isometric view of a land grid array (LGA) connector assembly 1 in accordance with a preferred embodiment of the present invention. The LGA connector assembly 1 comprises a stiffener 2 defining locating members 4 around the respective corners for receiving and holding the electronics package (not shown) in position, an insulative housing 3 seated around the stiffener 2, a plurality of electrical contacts (not shown) received in the housing 3, and a pick up cap 5 removably attached to the stiffener 2. The pick up cap 5 provides a smooth flat top surface facilitating to be capable of being handled by a device, thereby manipulating the LGA connector assembly 1 to a desired location on a substrate circuit (not shown).

The stiffener 2 made of metal comprises a main portion 20 for receiving the insulative housing 3 and four extending portion 21 extending from four corners of the main portion 20. Four location members 4 locates around respective corners of the extending portion 21 and are physically separated from each other so as to commonly receive and hold the electronics package in position. The location member 4 includes a pair of locating elements 42, such as having a wall shape. The locating walls 42 are respectively disposed along the lengthwise side and the lateral side.

The insulative housing 3 includes four separate contact segments 31, 32, 33 and 34, and the four contact segments 31, 32, 33, 34 are combined to form a substantially rectangular socket body for engaging an array of conductive elements of the electronics package, which is just placed on the socket body. It should be noted that the rectangular socket body might include any suitable numbers of contact segments other than four contact segments 31, 32, 33, and 34 of this embodiment, for some manufacturing considerations, such as difficulties resulting from material flow and shrinkage problems that the conventional large socket body typically encounter. A multiplicity of passageways (not shown) is defined in a portion of the four contact segments 31, 32, 33 and 34. A plurality of electrical contacts is received in the passageways of each of the contact segments 31, 32, 33 and 34. Each contact has a contact portion (not shown) protruding outward from a top portion of the housing 3 for resiliently electrically contacting the IC package and a bottom portion (not shown) for electrically contacting the circuit board.

Figure 2:
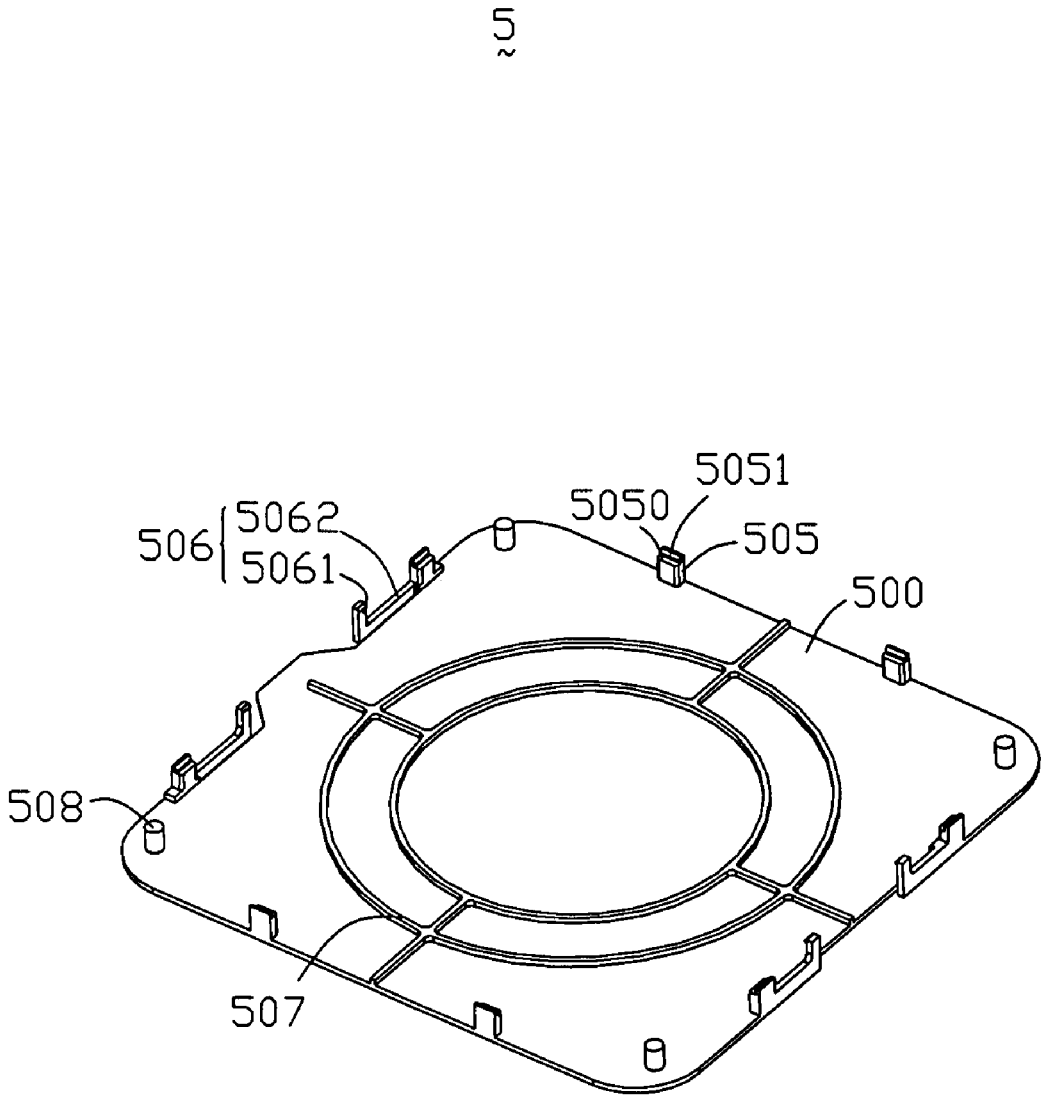
FIG. 2 is a bottom view of the pick up cap of FIG. 1.
Figure 3:
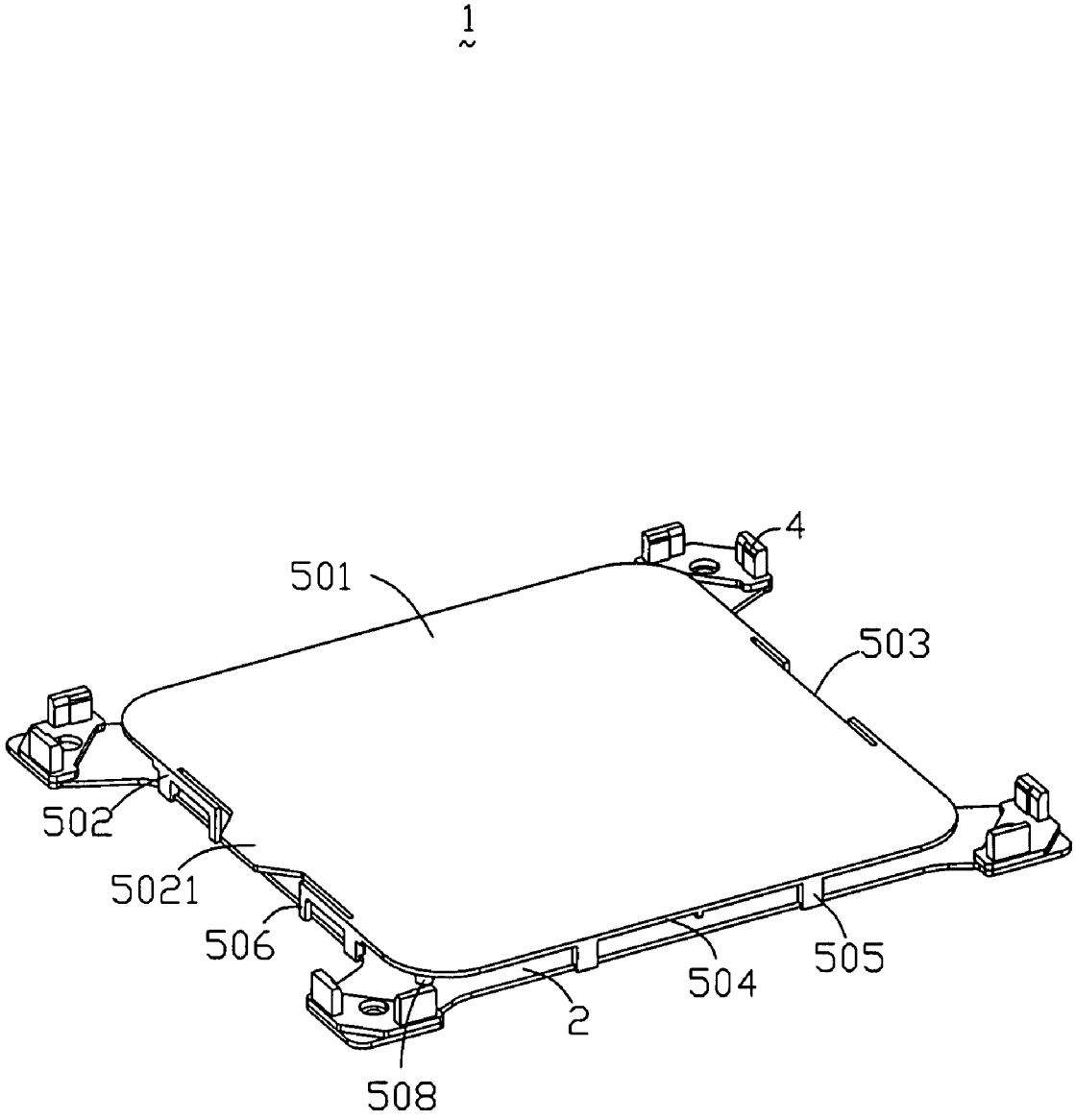
FIG. 3 is an assembled view of FIG. 1.

Referring to the FIGS. 1, 2 and 3, the pick up cap 5 has an approximately rectangular planar body 50. The planar body 50 comprises a smooth flat top surface 501 and a bottom surface 500, the smooth flat top surface 501 is used for moving the connector assembly 1 to a predetermined position cooperation with a device (not shown). The planar body 50 defines a first sidewall 502, a second sidewall 503 opposite to the first sidewall 502, and a pair of third sidewall 504 connecting the first sidewall 502 and the second sidewall 503. A tongue 5021 extends forward from the first sidewall 502 of the planar body 50 for removing the pick up cap 5 from the stiffener 2. The first sidewall 502, the second sidewall 503, and the third sidewall 504 each defines a plurality of securing portion 505 for securing the pick up cap 5 on the stiffener 2. The securing portion 505 has a ladder shape and comprises a mounting surface 5050 mounted on the stiffener 2 and a retention surface 5051 abutting on a side edge of the stiffener 2. A pair of clasps 506 extends from the securing portion 505 of the first sidewall 502 and the second sidewall 503 along a direction parallel to the first sidewall 502 and the second sidewall 503, respectively. The clasp 506 has an "L" shape and comprises a hook 5061 buckling the bottom of the stiffener 2 for retaining the pick up cap 3 on the stiffener 2 and a connection portion 5062 connecting the securing portion 505 and the hook 5061. The clasp 506 is spaced from the first sidewall 502 and the second sidewall 503, respectively, for adding the elasticity of the clasp 506. The bottom surface 500 of the planar body 50 defines a plurality of symmetrical ribs 507, those ribs are used not only for adding the strength of the pick up cap 5, but also preventing deformation of the pick up cap 5 when the pick up cap 5 is pressed. Four same shape columniform protrusions 508 extend downward from the four corners of the bottom surface 500 of the planar body 50 and abut on the top surface of the stiffener 2 for prevent damaging of the pick up cap 5 when the pick up cap 5 is pressed.

Assembling the locating members 4 and the insulative housing 3 around the stiffer 2, buckling the pick up cap 5 on the stiffener 2, now, the clasp 506 is buckled on the bottom surface of the stiffener 2, the securing portion 505 is abutted on the edge of the stiffener 2 and the columniform protrusion 508 is holded on the top surface of the stiffener 2, and then the LGA connector assembly 1 can be moved to a predetermined position by the pick up cap 5 accurately and the electrical contacts can be avoided damaging since the pick up cap covers the insulative housing 3.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. A land grid array (LGA) connector assembly, comprising:

a stiffener defining locating members around the respective corners for receiving and holding the electronics package in position;

an insulative housing, the housing defining a plurality of contact segments for engaging respective connection sections of an electronics package;

a plurality of electrical contacts received in the contact segments of the housing;

a pick up cap removeably attached to the stiffener, providing a smooth flat top surface facilitating to be capable of being handled by a device, thereby manipulating the LGA connector assembly to a desired location on a substrate circuit;

wherein there are four separate contact segments, each contact segment defining one corresponding corner;

wherein the stiffener comprises a main portion and four extending portion extending from the corner of the main portion, and the locating members are disposed on the extending portion.

2. The LGA connector assembly as claimed in claim 1, wherein each of said location members includes two locating elements, said two locating elements respectively disposed along a lengthwise side and a lateral side of each corner.

3. An LGA connector assembly comprising:

an insulative housing defining an upward receiving cavity with a plurality of contacts disposed in the housing and extending into said receiving cavity;

a stiffener supportably fully surrounding the housing; and a pick up cap mounted upon the housing and defining one main planar body with thereof downwardly extending hooks latched to the stiffener.

4. The LGA connector assembly as claimed in claim 3, wherein a plurality of ribs are formed on an underside of the pick up cap engaged with the housing.

5. The LGA connector assembly as claimed in claim 3, wherein the housing includes a plurality of sub-housings symmetrically arranged with one another with regard to a center.

6. The LGA connector assembly as claimed in claim 4, wherein the ribs are symmetrically arranged with a first center.

7. The LGA connector assembly as claimed in claim 6, wherein the housing includes a plurality of sub-housings symmetrically arranged with one another with regard to a second center.

8. The LGA connector assembly as claimed in claim 7, wherein said first center and said second center are aligned with each other.

9. An electrical connector for connecting an IC package comprising:

an insulative housing assembly;

a plurality of contacts retained in the housing assembly for connecting the IC package;

an individual metal stiffener of a substantial rectangular frame surrounding the housing assembly and engaging outer side edges to strengthen the housing assembly, the metal stiffener extending at corners to connect locating members for positioning the IC package; and a pick up cap covering upon the housing assembly with clasps latched to the stiffener.

10. The electrical connector as claimed in claim 9, wherein the stiffener is of a thin plate, with an up surface lower than an up surface of the housing assembly.

11. The electrical connector as claimed in claim 10, wherein the housing assembly includes four individual segments, each of which is of an L like shape.

12. The electrical connector as claimed in claim 11, wherein the pick up cap has at least one supporting pillar extending toward the stiffener and being capable of abutting against the stiffener when a downward force is applied upon an up surface of the pick up cap.

13. The electrical connector as claimed in claim 3, wherein said pick up cap defines a plurality of downwardly extending pieces engaged with all four corresponding side edges of the stiffener, respectively, so as to attach the pick up cap to the stiffener without vertical and horizontal movements thereof.

14. The electrical connector as claimed in claim 3, wherein said planar body includes two said hooks on one side edge with a tongue therebetween along said side edge, said tongue extending outwardly for removing the pick up cap from the stiffener.

* * * * *